US006328098B1

(12) United States Patent
Kodumudi et al.

(10) Patent No.: US 6,328,098 B1
(45) Date of Patent: Dec. 11, 2001

(54) SIDE MEMBER FOR HEAT EXCHANGER AND HEAT EXCHANGER INCORPORATING SIDE PLATE

(75) Inventors: Magesh V. Kodumudi, Rochester Hills, MI (US); Paul R. Smith, Sinclairville, NY (US)

(73) Assignee: Valeo Inc., Aurburn Hills, MI (US)

( * ) Notice: Subject to any disclaimer, the term of this patent is extended or adjusted under 35 U.S.C. 154(b) by 0 days.

(21) Appl. No.: 09/189,831

(22) Filed: Nov. 10, 1998

(51) Int. Cl.[7] ..... F28D 1/00; F28F 7/00

(52) U.S. Cl. ..... 165/149; 165/81; 165/82

(58) Field of Search ..... 165/149, 81, 82

(56) References Cited

U.S. PATENT DOCUMENTS

| | | | | |
|---|---|---|---|---|
| 3,939,908 | | 2/1976 | Chartet . | |
| 4,719,967 | * | 1/1988 | Scarselletta | 165/149 |
| 4,721,069 | * | 1/1988 | Kreider | 165/82 |
| 4,876,778 | | 10/1989 | Hagihara et al. . | |
| 5,186,239 | | 2/1993 | Young et al. . | |
| 5,613,551 | * | 3/1997 | Rhodes | 165/149 |
| 5,931,223 | * | 8/1999 | Yu et al. | 165/81 |
| 5,954,123 | * | 9/1999 | Richardson | 165/149 |

FOREIGN PATENT DOCUMENTS

| | | | | |
|---|---|---|---|---|
| 19753408 | * | 12/1997 | (DE) . | |
| 197 53 408 A 1 | | 6/1999 | (DE) . | |
| 0 748 995 A2 | | 12/1996 | (EP) . | |
| 1423854 | * | 2/1976 | (GB) | 165/149 |
| 0131898 | * | 2/1990 | (JP) | 165/149 |
| 402050088 | * | 2/1990 | (JP) | 165/149 |
| 405157484 | * | 6/1993 | (JP) | 165/149 |

OTHER PUBLICATIONS

European Search Report for App No. EP 99 12 2223.
Derwent Abstract for DE 197 53 408 A 1.

* cited by examiner

*Primary Examiner*—Ira S. Lazarus
*Assistant Examiner*—Tho Van Duong
(74) *Attorney, Agent, or Firm*—Morgan & Finnegan, LLP

(57) ABSTRACT

A side member for a heat exchanger has a portion which is adapted to preferentially break under low tension to alleviate problems caused by expansion, whilst retaining integrity under normal transport movements.

5 Claims, 5 Drawing Sheets

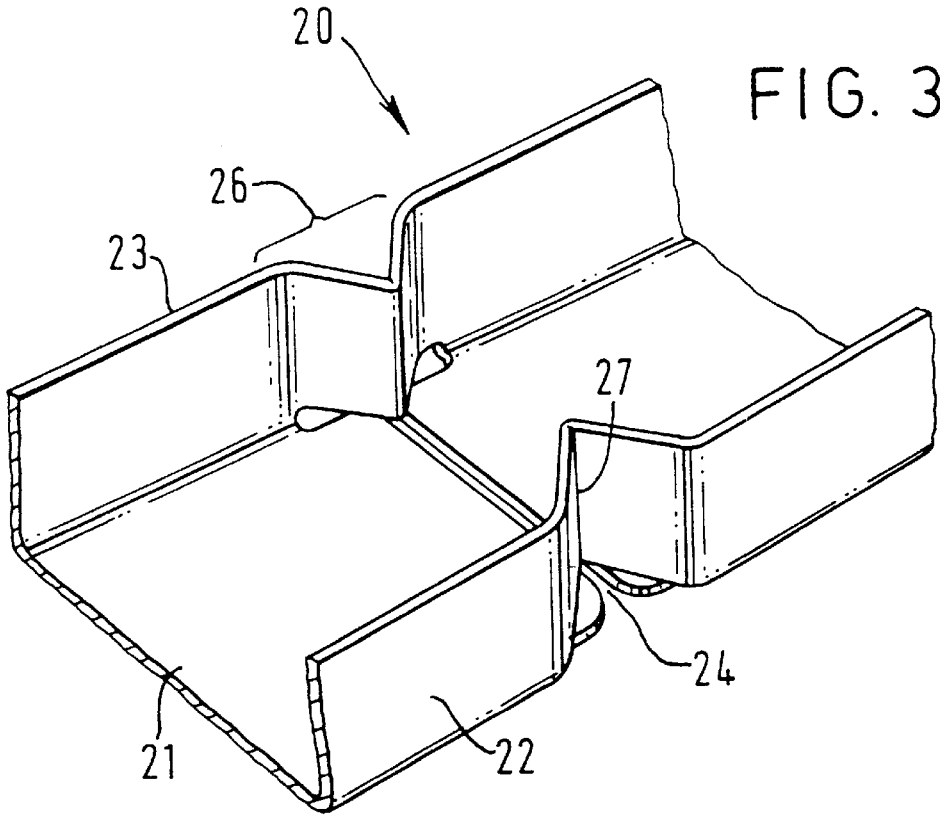
FIG. 3.
FIG. 4.
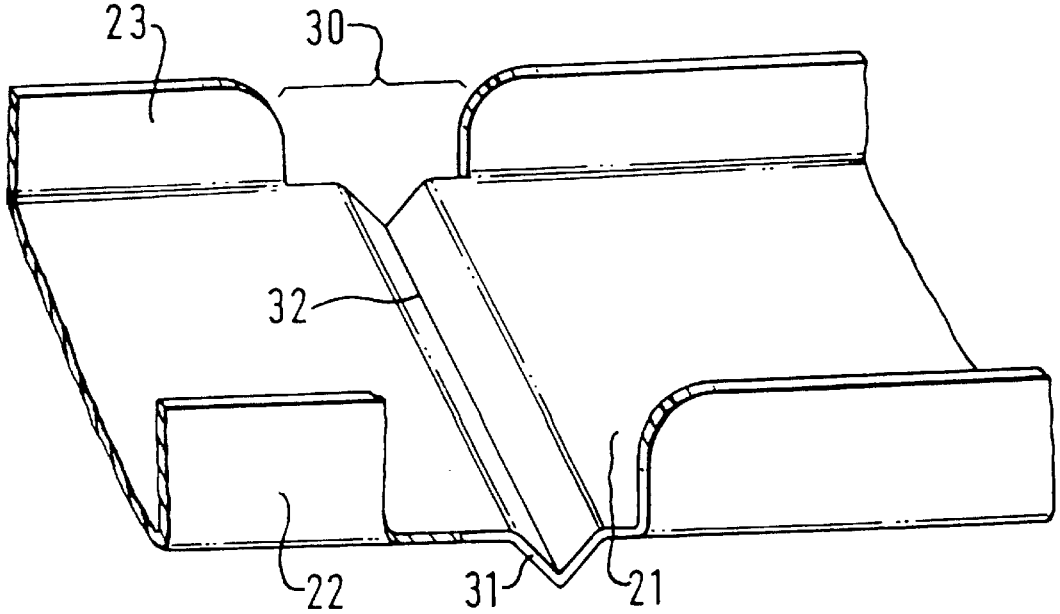

SIDE MEMBER FOR HEAT EXCHANGER AND HEAT EXCHANGER INCORPORATING SIDE PLATE

FIELD OF THE INVENTION

The present invention relates to a side member for a heat exchanger, and more particularly to such a side member which can alleviate problems caused by expansion. The invention also relates to a heat exchanger incorporating such a side member.

BACKGROUND OF THE INVENTION

Heat exchanger, such as radiators and condensers, conventionally consist of plural tubes extending between two tanks each for coolant or refrigerant or two headers (each associated with a tank) with fins (also called separators) disposed between the tubes. Usually there are also two end fins to cover the exposed surface of the two end tubes. To protect the end fins and to provide structural support and rigidity to entire unit, two support members (referred to hereinafter as side plates or side members), one on each end, extends between the headers or the tanks, as the case may be. These two side plates then form part of the outer periphery of the heat exchanger.

In use, hot fluid passes through the tubes and a passage of air over the tubes and the fins reduces the temperature of the fluid. However, since the overall temperature of the tubes is relatively high, the tubes thermally expand by a substantial amount with respect to their length when cold.

U.S. Pat. No. 3,939,908 relates to a radiator in which the problem caused by expansion of the tubes and a lesser degree of expansion of the side plates of the radiator is mitigated, by an expansion joint system.

The present assignees have provided a first solution to the problem of thermal expansion, which can lead to high stress in the tubes, or in the joint between the tube and the tank or header, by cutting the side plate of the heat exchanger which thereby allows the tubes to expand. This technique has however proved problematic. Firstly, cutting the side plate after brazing the tubes to the tank creates an additional operation which increases the cost of the heat exchanger. Cutting the plate is liable to increase the likelihood of the tubes being damaged, which causes wastage. Cutting the side plate also greatly reduces the structural integrity of the heat exchanger which can lead to damage during shipping, handling and installation.

SUMMARY OF THE INVENTION

It is therefore an object of the present invention to at least partially mitigate the above-mentioned difficulties.

According to a first aspect of the present invention there is provided a side member for a heat exchanger, the side member having a portion adapted to break under relatively low tension.

According to a second aspect of the present invention there is provided a side member for a heat exchanger having a first and a second header or tank, the side member having a first portion for extending from the first header/tank towards the second header/tank, a second portion for extending from the second header/tank towards the first header/tank, and a third portion disposed between the first and second portions, wherein the structural integrity of the third portion is substantially less than that of the first and the second portions.

According to a third aspect of the present invention there is provided a side member for a heat exchanger comprising a channel-shaped member having a base wall and two opposing side walls depending from the base wall, the side member having a portion wherein the side walls are interrupted and the base wall includes a region of weakness.

According to a fourth aspect of the present invention there is provided a side plate for a heat exchanger comprising a channel-shaped member having a base wall and two opposing side walls depending from the base wall, the side member having a portion wherein the base wall is interrupted and the side walls include a region of weakness.

Preferably the portion adapted to break under low tension includes a sharp fold in the side member.

Preferably the region of reduced structural integrity is provided by a sharp fold region in the side member.

Advantageously the region of weakness of the base wall comprises a sharp fold region in the base wall.

Preferably the base wall is scored in said sharp fold region.

According to a further aspect of the present invention there is provided a heat exchanger having a first and a second header or tank, plural tubes extending between the first and second header/tanks and at least one side plate extending alongside the tubes to connect together the first and second header/tanks, the side plate having a first portion extending from the first header/tank towards the second header/tank, a second portion extending from the second header/tank towards the first header/tank and a third portion disposed between the first and second portions, wherein the structural integrity of the third portion is substantially less than that of the first and second portions.

Advantageously the side plate comprises a channel-shaped member having a base wall and two opposing side walls depending from the base wall, the third portion of the side plate comprising a region wherein the side walls are interrupted and the base wall includes a region of weakness.

Alternatively the side plate may comprise a channel-shaped member having a base wall and two opposing side walls depending from the base wall, and the third portion of the side plate has a region wherein the base wall is interrupted and the side walls include a region of weakness.

BRIEF DESCRIPTION OF THE DRAWINGS

Preferred embodiments of the present invention will now be described with reference to the accompanying drawings in which:

FIG. 3 shows a detailed view of a region of reduced structural integrity of the side plate of the radiator of FIG. 2.

FIG. 4 shows an alternative embodiment of the invention.

DESCRIPTION OF THE PREFERRED EMBODIMENTS

Figure 1:
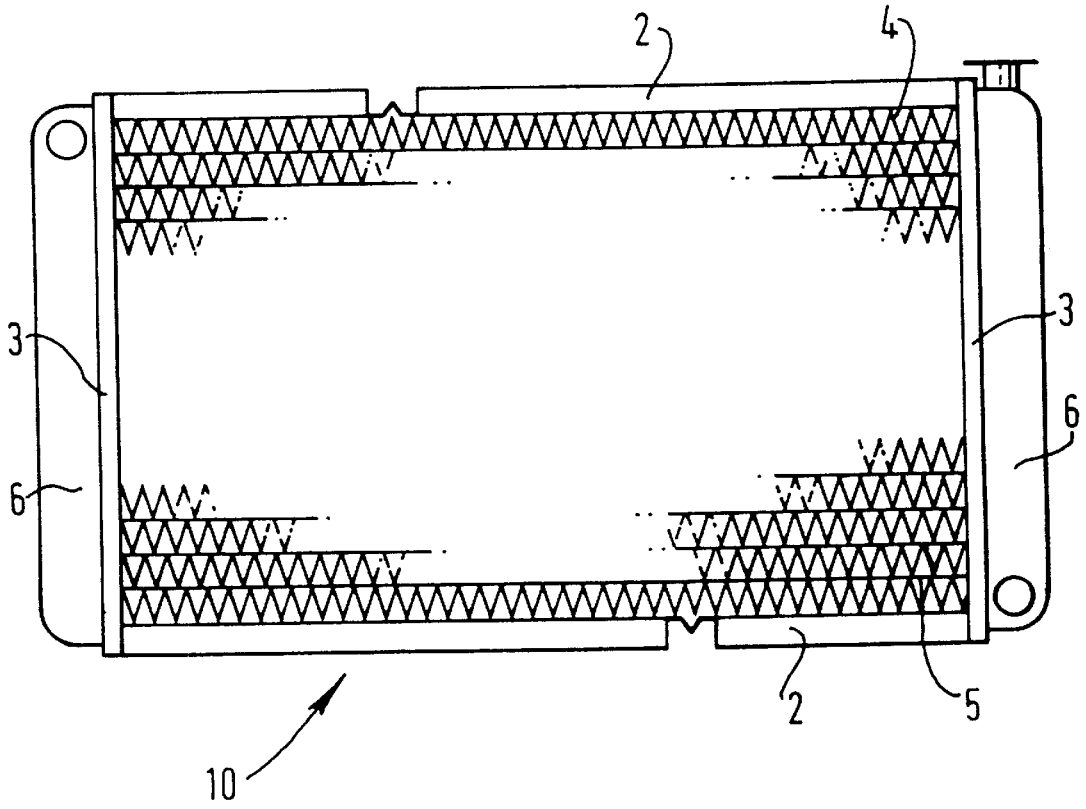
FIG. 1 shows a schematic view of a radiator.

Referring first to FIG. 1, a radiator (10), such as an automotive radiator, generally comprises a pair of headers (3) each associated with a respective tank (6), the headers being spaced apart by a pair of spacer members (2) typically of metal, and the headers being connected by plural core tubes (5). Between respective pairs of the core tubes (5) there are disposed fins (4), as known in the art. If the radiator is adapted to be disposed for vertical flow of coolant in the tubes, then the two headers are disposed one above the other and the two spacer members (2) are known as side plates. Alternatively, it is possible to dispose the two headers such that the spacer members extend horizontally in which case they are commonly referred to as top and bottom plates. However the purpose of this description, the term "side plates" will be used without restriction as to the actual disposition of the radiator in use.

The core tubes (5) pass through a wall (7) of the header in a manner known in the art. The outer periphery of each of the tubes is secured to the wall (7), (see FIG. 3) for example by brazing, again as is known in the art.

In use, coolant heated by the engine of the associated vehicle enters one tank and flows through the core tubes. The high temperature of the fluid causes heat transfer by conduction and connection to the walls of the tube and on to the fins of the radiator. Air passes over the fins and over the outer periphery of the tubes to cool the fluid therein in a known fashion. Typically the tubes may be of aluminum or brass both of which have relatively high coefficients of expansion. Thus the hot water causes the tubes to tend to expand thus increasing the separation between the two headers. However, use of a conventional side plate would substantially maintain the spacing between the two headers, because the side plates are not subjected to the same high temperatures as the tubes. The result of the tendency of the tubes to grow in length is to place high stresses on the region where the tubes are secured to the header/tank wall and this may lead to failure.

Figure 2:
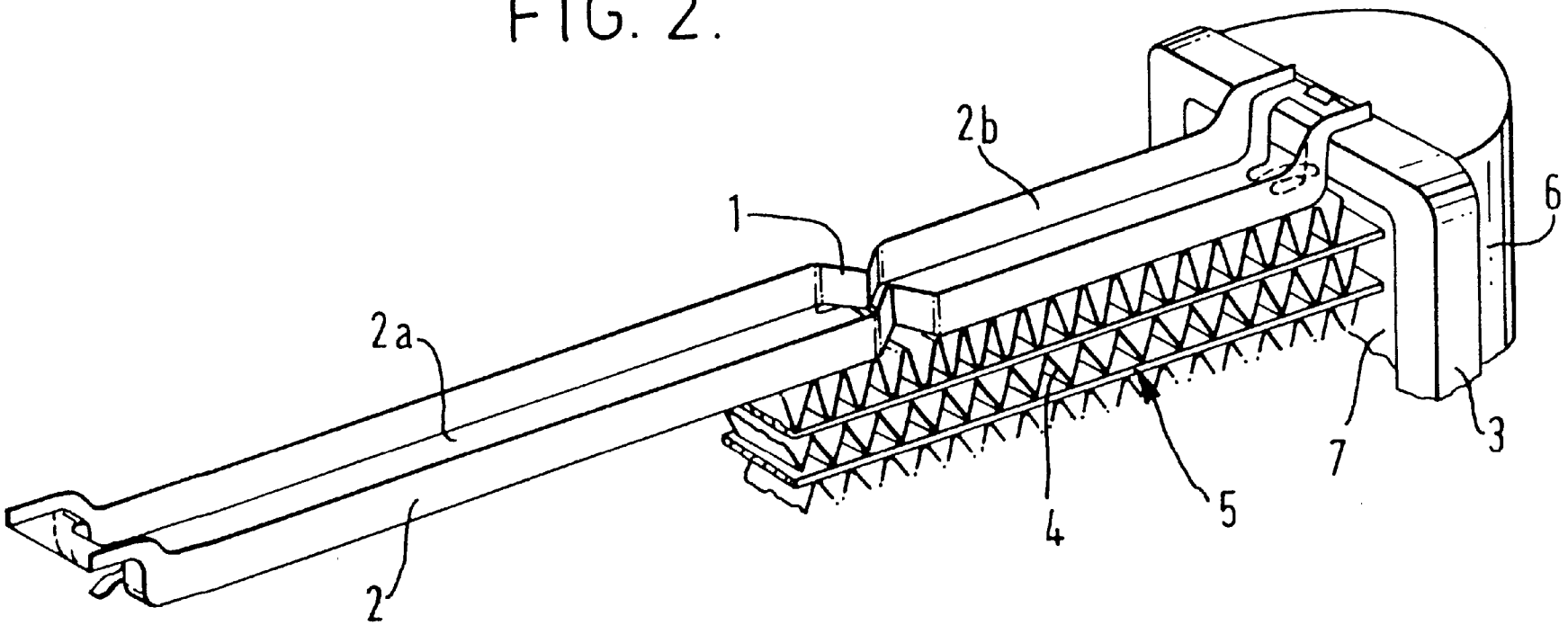
FIG. 2 shows a partial cutaway view of a portion of the radiator of FIG. 1 showing the present invention.

Referring to FIG. 2, the invention provides a portion (1) of the side plate which is adapted to break under relatively low tension. Thus, the side plate has a first portion (2*a*) extending from the first header/tank (not shown) towards the second header tank (3) and a second portion (2*b*) extending from the second header/tank (3) towards the first header/tank, there being a third portion (1) between the first and second portions, the third portion having a structural integrity which is substantially less than that of the first and second portions.

Referring now to FIG. 3, a side plate (20) consists of a channel-shaped member having a base wall (21) and two opposing side walls (22,23) depending from the base wall. The side plate has a portion wherein the base wall is interrupted, for example by cutting through the base wall to provide a slit (24). In the region where the base wall is interrupted, the side walls have a region of weakness (26). This weakness may be provided by deforming the walls inwardly towards one another, by scoring along a score line (27), or by a combination of the two. Other methods of weakening the walls will be apparent to one skilled in the art, for example by perforating the side walls in this region, or by deforming the walls outwardly.

FIG. 4 shows an alternative structure having reduced integrity in a defined region, again applied to a channel-shaped member having a base wall (21) opposing side walls (22,23). Referring to FIG. 4, it will be seen that the side walls have been interrupted, for example by cutting out a portion of the side walls so that for a portion (30) of the extent of the side plate no side walls are present. Within this region the base wall is weakened, as shown by deforming the base wall in a direction opposite to the extent of the side walls, to provide a V-shape (31). It will be clear to one skilled in the art that other methods can be used for reducing the structural integrity of the side plate in a predetermined region thereof, for example perforating the region.

Figure 5:
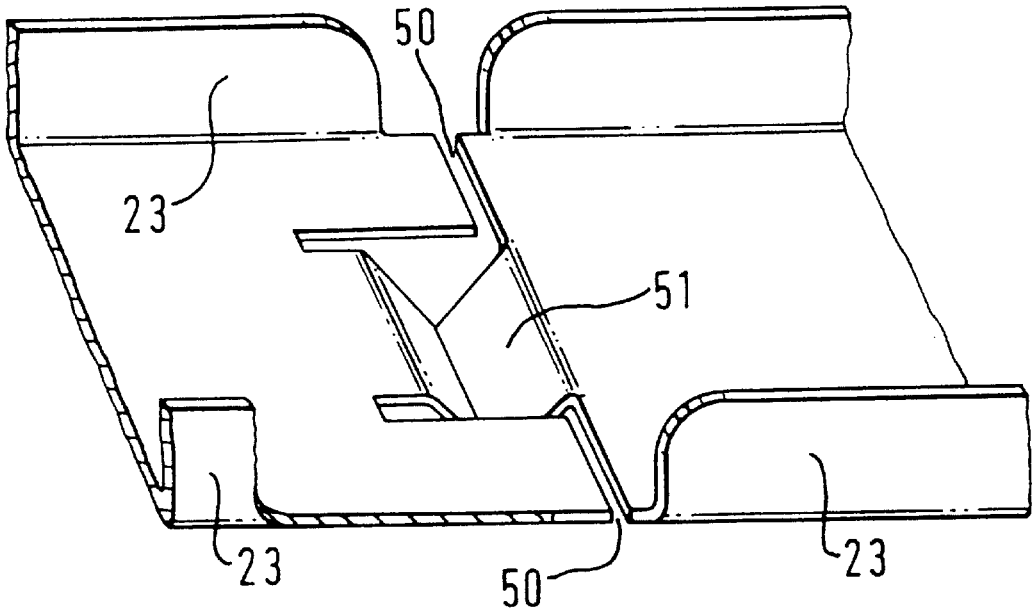
FIG. 5 shows alternative embodiments.
Figure 6:
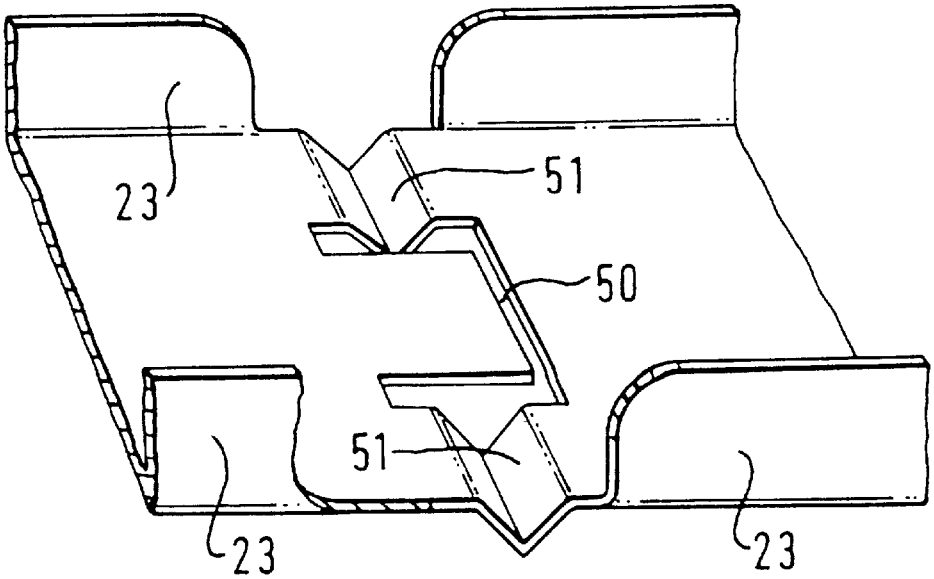
FIGS. 6–8 show modifications of FIGS. 3–5.
Figure 7:
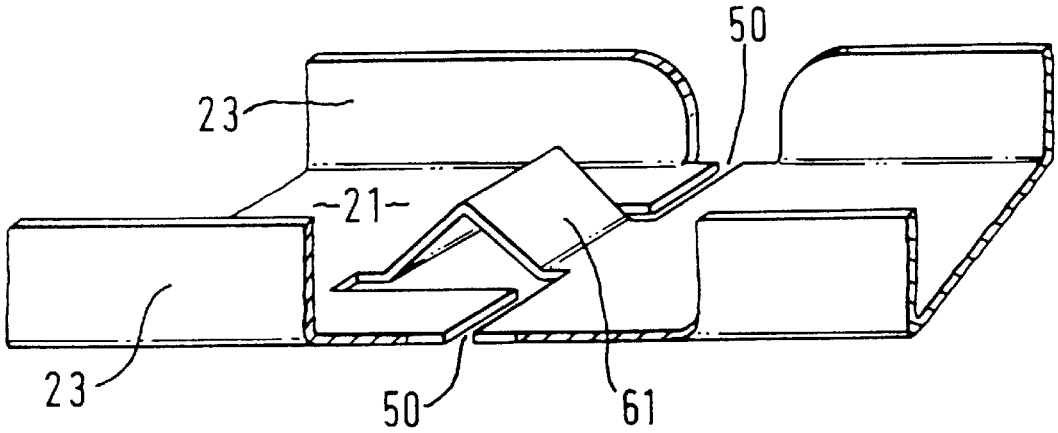
Figure 8:
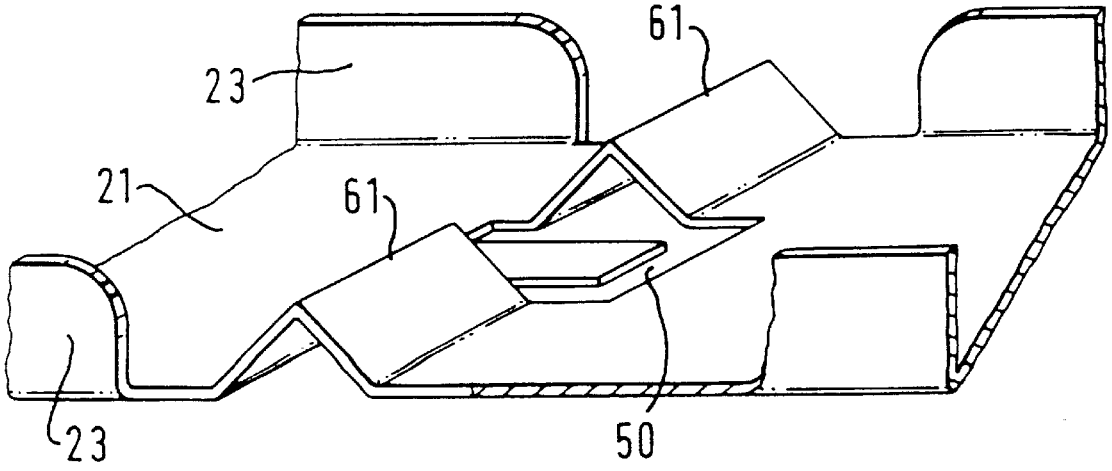

FIGS. 5 and 6 show modifications of the embodiment of FIG. 4, in which not only are portions of the side walls interrupted, but also one or more slits (50) are cut in the base wall, the slits not extending for the full extent of the base wall, a remainder of the base wall (21) being deformed in one or more V-shapes (51) in the direction opposite to the extent of the side walls. FIGS. 7 and 8 show similar arrangements to those of FIGS. 4 and 5, but with the deformed portion or portions (61) of the base wall in the same direction as the extent of the side walls therefrom.

The side plates are manufactured according to one of the disclosed embodiments or an equivalent thereof, before assembly of the radiator itself. This prevents the likelihood of damage which would occur if cutting or deforming operations were performed on the side plate whilst it was secured to the radiator.

The region of reduced structural integrity of the side plate is sufficiently strong to maintain the overall integrity of the radiator during manufacture, transport, handling and installation. However, after installation into a vehicle and being subjected to normal operating conditions, the tendency of the tubes to expand in length causes the region of reduced structural integrity to suffer fatigue and to fracture, which in turn permits the expansion of the tubes without stressing connections between the tubes and the headers at either or both ends thereof.

It will be clear to those skilled in the art that although embodiments relating to radiators have been described, nonetheless the invention is equally applicable to heat exchanges in general, and specifically to condensers and oil coolers. Where the present description discusses coolant in the context of a radiator, a condenser passes a refrigerant and an oil cooler passes oil to be cooled.

Although the invention has been described with respect to a number of embodiments, it will be understood by one skilled in the art that other embodiments can be produced without departing from the spirit and scope of the invention as defined in the accompanying claims.

What is claimed is:

1. A side member for a heat exchanger, the side member formed from single piece of material and having a portion with a reduced structural integrity, the portion including a base wall interrupted with a slit, and opposing side walls depending from the base wall and having a region of weakness corresponding to the slit, each region of weakness formed by one of a deformation or, a score along a score line, the region of weakness breaking under relatively low tension applied by thermal expansion and contraction of the heat exchanger under normal operating conditions.

2. A side member as claimed in claim 1 wherein the region of weakness includes a sharp fold.

3. A side member for a heat exchanger, the heat exchanger having a first header/tank and a second header/tank, the side member formed from single piece of material and having a first portion for extending from the first header/tank towards the second header/tank, a second portion extending from the second header/tank towards the first header/tank, and a third portion disposed between the first portion and the second portion, each portion having a structural integrity, wherein the structural integrity of the third portion is substantially less than the structural integrity of the first portion and the second portion, the third portion including a base wall interrupted with a slit, and opposing side walls depending from the base wall and having a region of weakness corresponding to the slit, each region of weakness formed by one of a deformation or, a score along a score line, and wherein the third portion breaks under relatively low tension applied by thermal expansion and contraction of the heat exchanger under normal operating conditions.

4. A side member as claimed in claim 3 wherein the region of weakness includes a sharp fold.

5. A side member for a heat exchanger comprising a channel shaped member formed from single piece of material and having a base wall and two opposing side walls depending from the base wall, the channel shaped member having a portion wherein the base wall is interrupted and the corresponding side walls include a region of weakness formed by one of a deformation or, a score along a score line, each region of weakness breaking under relatively low tension applied by thermal expansion and contraction of the heat exchanger under normal operating conditions.

* * * * *